United States Patent [19]

Haber

[11] 3,994,044

[45] Nov. 30, 1976

[54] HINGE CONSTRUCTION FOR LIDDED VESSELS

[76] Inventor: Robert H. Haber, 834 Edward St., Baldwin, N.Y. 11510

[22] Filed: Dec. 15, 1975

[21] Appl. No.: 640,695

[52] U.S. Cl. ..... 16/128 R

[51] Int. Cl.[2] ..... E05D 9/00

[58] Field of Search ..... 16/128 R, 135, 137, 16/166, 168, 169; 220/200, 263, 264, 91, 92

[56] References Cited

UNITED STATES PATENTS

| | | | |
|---|---|---|---|
| 75,903 | 3/1868 | Hauck | 16/128 R |
| 665,940 | 1/1901 | Schwenker | 16/128 R |
| 1,465,116 | 8/1923 | Dewire | 16/128 R |
| 1,936,465 | 11/1933 | Whitlock | 16/128 R |

*Primary Examiner*—G. V. Larkin

*Attorney, Agent, or Firm*—Charles E. Temko

[57] ABSTRACT

A heavy duty hinge construction for lidded vessels such as coffee pots, sugar bowls and the like, particularly suited for restaurant and other commercial environs, and adapted to withstand substantially continued use, while permitting substantially 180° pivotal movement of the lid to enable washing with automatic equipment.

5 Claims, 10 Drawing Figures

FIG. 1
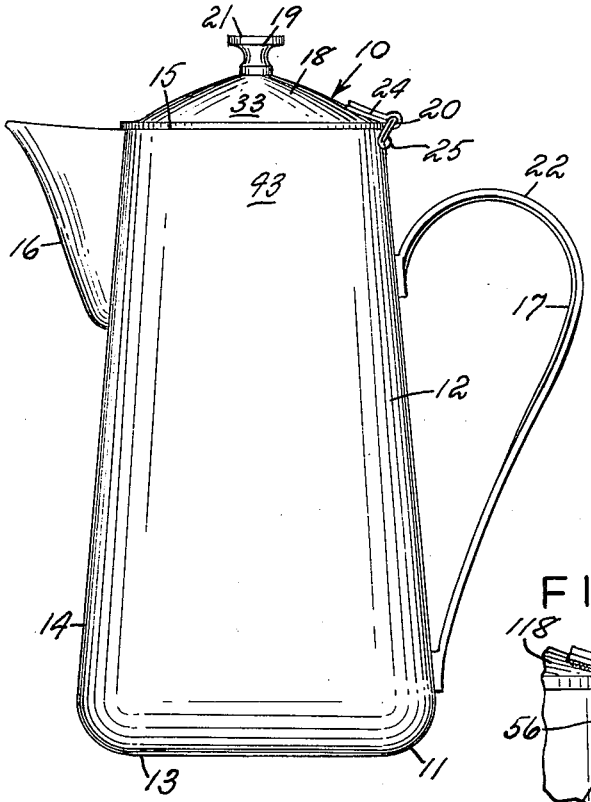
FIG. 4
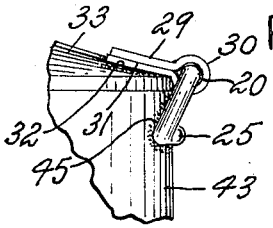
FIG. 5
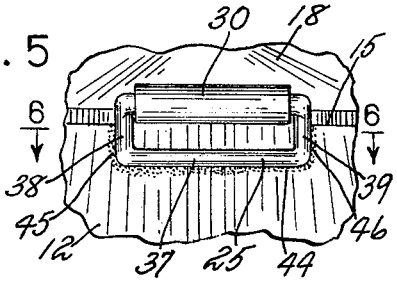
FIG. 8
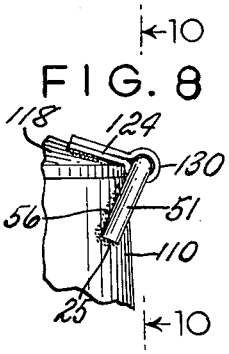
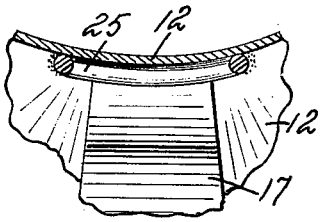
FIG. 6
FIG. 2
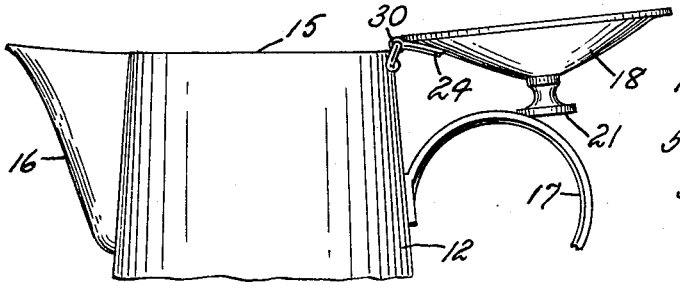
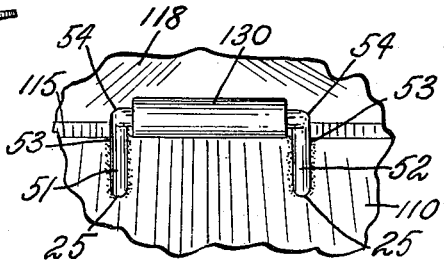
FIG. 9
FIG. 3
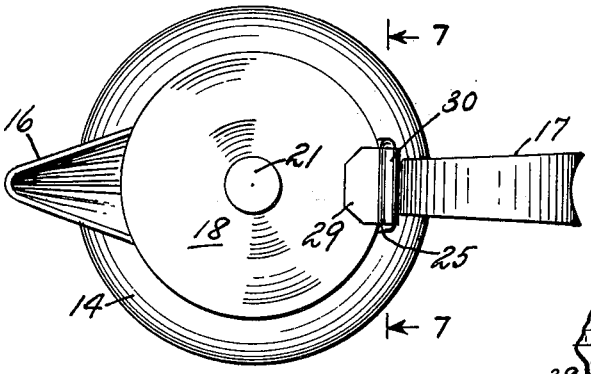
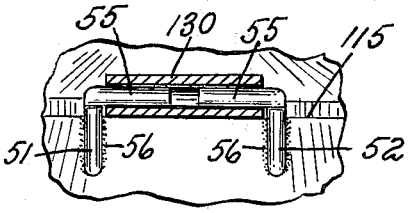
FIG. 10
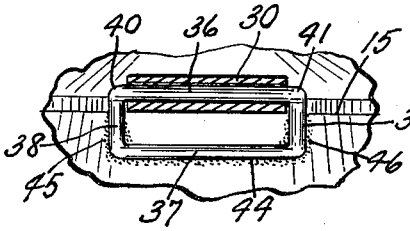
FIG. 7

HINGE CONSTRUCTION FOR LIDDED VESSELS

BACKGROUND OF THE INVENTION

Pivotal lid coffee pots and the like have been well known in the art for centuries. For the most, pivotal interconnection of the lid to the vessel has been by interconnecting each part using a well known multileaf hinge in which the leaves are mutually interconnected by a pintle, the axis of which forms the axis of rotation. Other constructions have employed a clevis type arrangement, again using a pintle. In each case, with continued use and washing, the headed portions of the pintle tend to become damaged, so that the pintle is permitted to slide from engagement between the leaves rendering replacement or repair necessary. In addition, the barrel of the hinge, being relatively fragile, is also subject to easily imparted damage. Another construction utilizes a horizontally oriented slot cut in the wall of the vessel near the upper edge thereof. The lid mounts a curved projection which pivotally engages the slot. While durable, the construction is not very attractive, and permits the liquid contents of the vessel to spill through the slot when the vessel is manually carried. This construction also permits the lid to move laterally of the vessel as well as pivot.

SUMMARY OF THE INVENTION

Briefly stated, the invention contemplates the provision of an improved hinge construction the lidded vessels of the class described, in which the hinge element comprises a first member forming a transversely extending cylindrical channel, one surface of the first member being soldered to an exposed surface of either the lid or the vessel. The other hinge member is formed from a wire-like member, a portion of which at least partially extends into the above mentioned channel, and the other portion of which is soldered to an outer surface of the corresponding part of the vessel adjacent a free edge. In one embodiment, the second mentioned hinge member is in the form of a rectangularly shaped loop. In another embodiment, the loop is discontinuous, and the exposed ends of the same are soldered to an outer surface of the vessel.

BRIEF DESCRIPTION OF THE DRAWING

In the drawing, to which reference will be made in the specification, similar reference characters have been employed to designate corresponding parts throughout the several views.

FIG. 1 is a side elevational view of a first embodiment of the invention.

FIG. 2 is a fragmentary elevational view of the first embodiment, showing a lid element in opened condition.

FIG. 3 is a top plan view as seen from the upper portion of FIG. 1.

FIG. 4 is a fragmentary enlarged elevational view corresponding to the upper right hand portion of FIG. 1.

FIG. is a fragmentary side elevational view as seen from the right hand portion of FIG. 4.

FIG. 6 is a fragmentary horizontal sectional view as seen from the line 6—6 in FIG. 5.

FIG. 7 is a fragmentary vertical sectional view as seen from the line 7—7 in FIG. 3.

FIG. 8 is a fragmentary view in elevation corresponding to that seen in FIG. 4, and showing a second embodiment of the invention.

FIG. 9 is a fragmentary elevational view as seen from the right hand portion of FIG. 8.

FIG. 10 is a fragmentary sectional view as seen from the line 10—10 in FIG. 8.

DETAILED DESCRIPTION OF THE DISCLOSED EMBODIMENTS

In accordance with the first embodiment of the invention, the device, generally indicated by reference character 10, is in the form of a conventional coffee pot 11. The pot includes a frusto-conical vessel element 12 having a bottom wall 13 and a continuous side wall 14. The vessel is bounded by an upper free edge 15 adjacent a pouring spout 16 communicating with the interior of the vessel. A handle 17 is conventionally positioned opposite the pouring spout. A dished lid element 18 includes a knob 19, and is interconnected to the vessel element 12 by hinge means 20. The means 20 permits the pivotal movement of the lid element 18 with respect to the vessel element 12 to a point where an upper surface 21 of the knob 19 contacts an upper surface 22 of the handle 17, in which condition the interior of the vessel may be conveniently washed.

The hinge means 20 includes first and second hinge members 24 and 25. Although illustrated with the member 24 attached to the lid element 18, and the member 25 attached to the vessel 12, it will be understood by those skilled in the art that the parts may be reversed within the scope of the invention.

The member 24 is formed from a single strip of metallic material bent to include an upper strap portion 29, a loop portion 30 and a lower strap member 31. The upper and lower strap portions 29 and 31 are soldered or spot welded together prior to interconnection of the lower surface 32 of the member 31 to a peripheral portion of the upper surface 33 of the lid element 18.

The second member 25, in the first embodiment, is formed as a continuous rectangular wire loop including an upper segment 36, a lower segment 37 and side segments 38 and 39. The upper segment 36 is engaged within the loop portion 30 prior to interconnection of the upper and lower strap members 29 and 31, and is of rectilinear configuration between points 40 and 41 to provide a pivotal axis of rotation. The lower segment 37 is soldered or welded to the outer surface 43 of the side wall 14 by solder 44 extending from point 45 to point 46. This segment may be curved about a radius substantially equivalent to that of the side wall 14, or the lower segment 37 may be tangentially positioned prior to the soldering or welding operation, as desired.

It will be observed that the interconnection of the members 24 and 25 is accomplished without the use of an independent pintle, and there are not free ends on the extremities of the upper segment 36.

Turning now to the second embodiment of the invention, generally indicated by reference character 110, parts corresponding to those of the first embodiment have been designated reference characters with the additional prefix 1.

In the second embodiment, the second hinge member 25 is formed from two separate pieces of wire 51 and 52. Each includes a vertical segment 53 which is soldered or welded to the outer surface of the vessel interconnected by a bent portion 54 to a horizontal segment 55 each of which is engaged within the loop portion 130. The soldered areas 56 may extend substantially the entire length of the vertical segments 53 for adequate strength. The second embodiment is particularly suitable for use where production facilities or procedures require that the member 124 be attached to the lid element 118 prior to interconnection with the vessel element 112.

In the second embodiment, as in the first embodiment, no pintle is employed to form the pivotal axis of movement, and there is no area on the wire-like members forming the axis of pivotal movement which can be damaged either by the application of forces in shear or co-axially.

I wish it to be understood that I do not consider the invention limited to the precise details of structure shown and set forth in this specification, for obvious modifications will occur to those skilled in the art to which the invention pertains.

I claim:

1. In a hingedly interconnected vessel and lid therefor, the improvement comprising: first and second hinge members; said first hinge member including first and second abutted strap portions interconnected by a loop portion to define a cylindrical channel, one surface of said first hinge member being interconnected to one of said lid and vessel; said second hinge member including a first segment of wire-like configuration penetrating said cylindrical channel, and a second segment integral with said first segment and interconnected to another surface of the other of said lid and vessel.

2. Structure in accordance with claim 1, further characterized in said second hinge member comprising a continuous rectangular loop of wire-like configuration.

3. Structure in accordance with claim 1, further characterized in said second hinge member including a separate pair of members of wire-like configuration, each including a first segment partially penetrating said cylindrical channel and a second segment secured to one of said lid and vessel.

4. Structure in accordance with claim 2, in which said second hinge member is secured to said vessel.

5. Structure in accordance with claim 3, in which said second hinge member is secured to said vessel.

* * * * *